US006145460A

United States Patent [19]

Brookes

[11] Patent Number: 6,145,460

[45] Date of Patent: Nov. 14, 2000

[54] FURLING BOOM

[76] Inventor: Thomas Joseph Brookes, PO Box 14, Mona Vale NSW 1660, Australia

[21] Appl. No.: 09/230,150

[22] PCT Filed: Jul. 24, 1997

[86] PCT No.: PCT/AU97/00469

§ 371 Date: Jan. 19, 1999

§ 102(e) Date: Jan. 19, 1999

[87] PCT Pub. No.: WO98/04456

PCT Pub. Date: Feb. 5, 1998

[30] Foreign Application Priority Data

Jul. 25, 1996 [AU] Australia ..... PO 2750

[51] Int. Cl.[7] ..... B63H 9/04

[52] U.S. Cl. ..... 114/106; 114/107

[58] Field of Search ..... 114/106, 107, 114/39.21, 102.1, 89, 97, 98, 99, 102.15

[56] References Cited

U.S. PATENT DOCUMENTS 4,116,152 9/1978 Larsson ..... 114/106
4,503,797 3/1985 Maurin .
5,640,919 6/1997 Huisman ..... 114/106

FOREIGN PATENT DOCUMENTS

65757/96 4/1997 Australia .
WO 87/02003 4/1987 WIPO .
WO 95/26296 10/1995 WIPO .

*Primary Examiner*—Stephen Avila
*Attorney, Agent, or Firm*—Jordan and Hamburg LLP

[57] ABSTRACT

A furling boom comprising: a drive housing adapted for mounting on a mast, the housing comprising a drive take off and a boom support. A boom of substantially c-shaped cross section is pivotally connected to said boom support by a universal joint and having its opening facing upwardly. An elongated mandrel extends within the boom and is connected at one end by a universal joint to the drive take off and at its other end by a rotating floating axle pivotally connected to the free end of the boom, whereby the foot of a said is connected to the mandrel and furled thereabout upon rotation of said mandrel. A drive unit mounted on said drive housing. The floating axle prevents binding and friction during furling and unfurling when the mandrel is bent upwardly. The drive housing reinforces the mast at the connection of the boom.

11 Claims, 10 Drawing Sheets

FURLING BOOM

The present invention relates to a furling boom for a yacht.

A problem that has beset sailors of modern yachts, is the difficulties and awkwardness associated with manually raising, reefing and furling of the mainsail. Attempts have been made to provide mechanically assisted furling devices for booms, with mixed success. Two prior art device are shown in Australian Patent no. 613630 and 636472. These devices require the drilling of a hole completely through the mast, for the drive shaft of the furling device, which weakens the mast.

The present invention seeks to ameliorate problems associated with the prior art furling devices. In one broad form the present invention provides a furling boom comprising:

a drive housing adapted for mounting on a mast, said housing comprising a drive take off and a boom support;

a boom of substantially c-shaped cross section, pivotally connected to said boom support, and having its opening facing upwardly;

an elongated mandrel extending within said boom and connected at one end by a universal joint to said drive take off, and at its other end by a rotating axle pivotally connected to the free end of the boom, whereby the foot of a sail is connected to said mandrel and furled thereabout upon rotation of said mandrel; and a drive unit mounted on said drive housing.

The drive unit could be electric, rope haul, hydraulic or manually operated, and preferably includes a manual over ride in the case of breakdown of the motor.

The present invention will now be described with reference to the accompanying drawings, in which.

Figure 1:
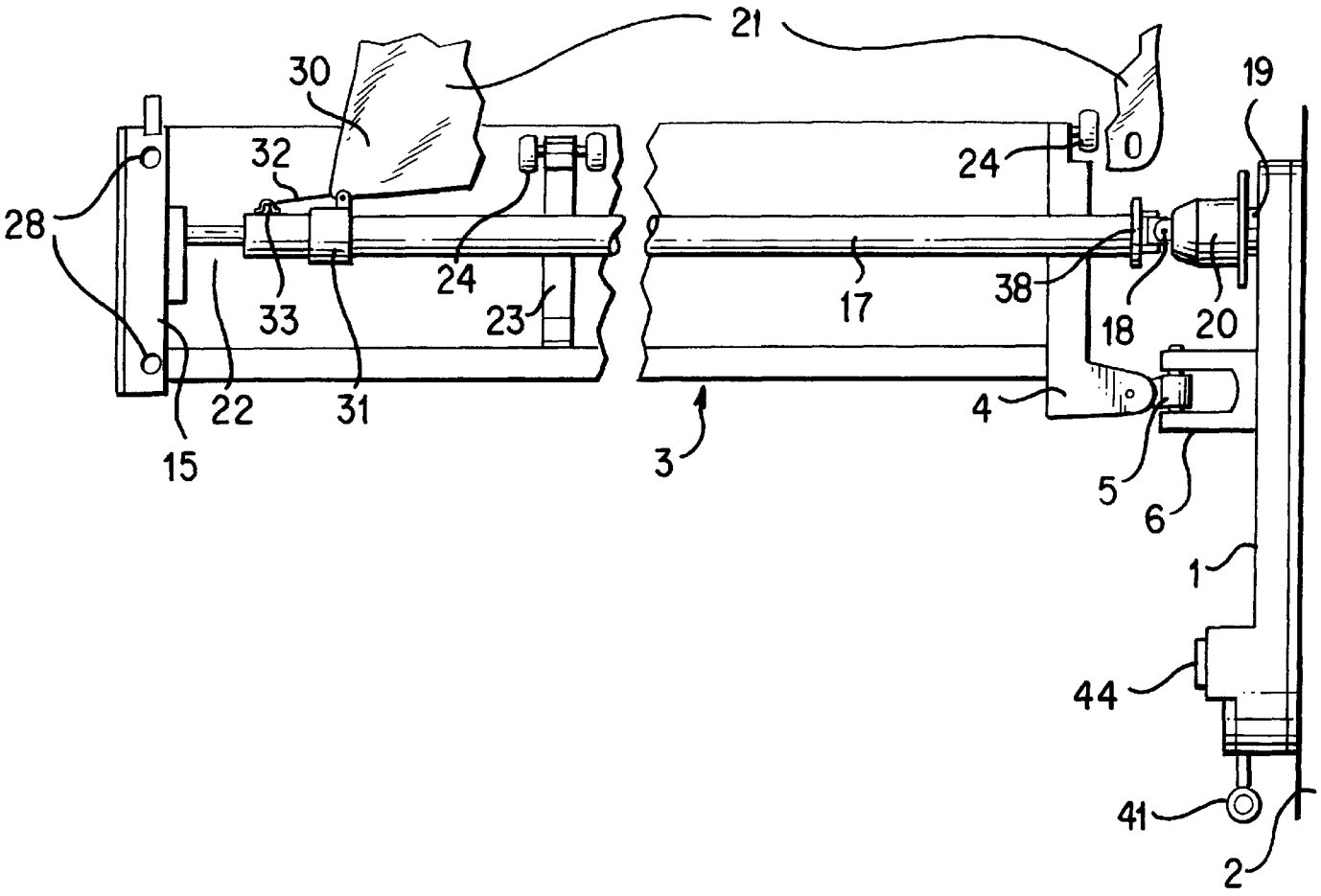
FIG. 1 shows a cut away side view of an embodiment of the present invention, affixed to a mast of a yacht.

As shown in FIG. 1, one embodiment of the present invention comprises a drive housing (1), which is adapted to be mounted onto the mast (2). The drive housing (1) reinforces the mast (2) at the connection of the boom (3). The boom (3) is connected at its end casting (4) by a universal joint (5), in this case a goose neck swivel, to the boom support (6) on the drive housing (1).

Figure 3:
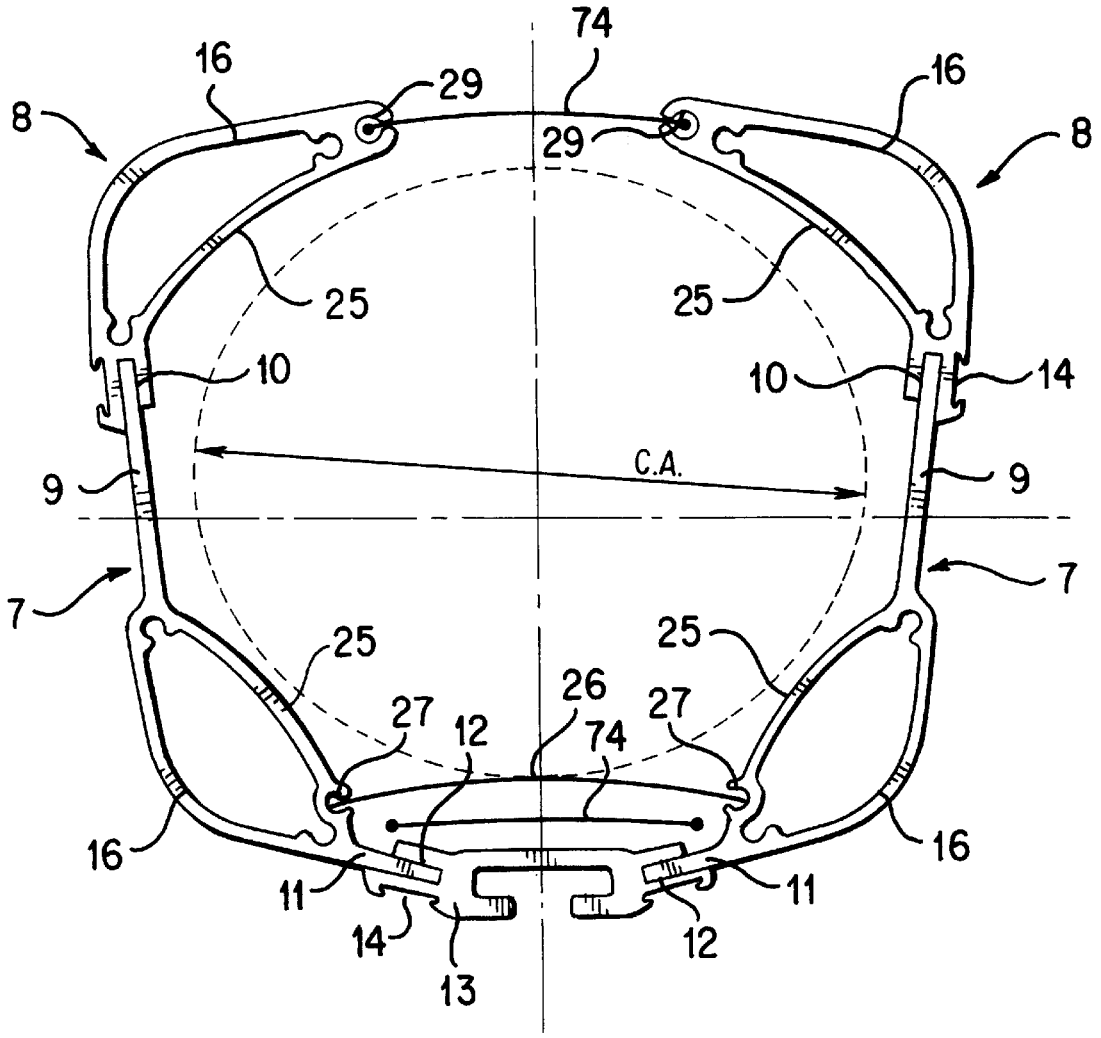
FIG. 3 illustrates a cross sectional view of the boom as shown in FIG. 1.

The boom (3) as shown in FIG. 3 comprises a lower boom extruded section (13), two common extruded side sections (7), and two common top extrusion (8). These are cut to the desired length of the boom. The height and width of the boom (3) is determined by cutting the arms (9) and (11) of the side sections (7) to the desired lengths, and sliding the arm (9) into the slot (10) and the arm (11) into the slot (12). The arms (9 & 11) are secured in the respective slots (10 & 12) by any suitable means, such as riveting through the grooves (14). A decorative strip (not shown) is then slid along the grooves (14) to hid the rivets. The cut along the arms (9 & 11) could be tapered to provided a tapered furling boom as less sail wraps around the mandrel (17) the further away from the mast (2), due to the triangular shape of the sail (21).

An open end c-shaped casting (4) is connected to the mast end of the boom (3) and a closed end casting (15) is connected to the free end of the boom (3). The reinforced corners (16) provide torsional and bending stability for the boom (3).

Figure 2:
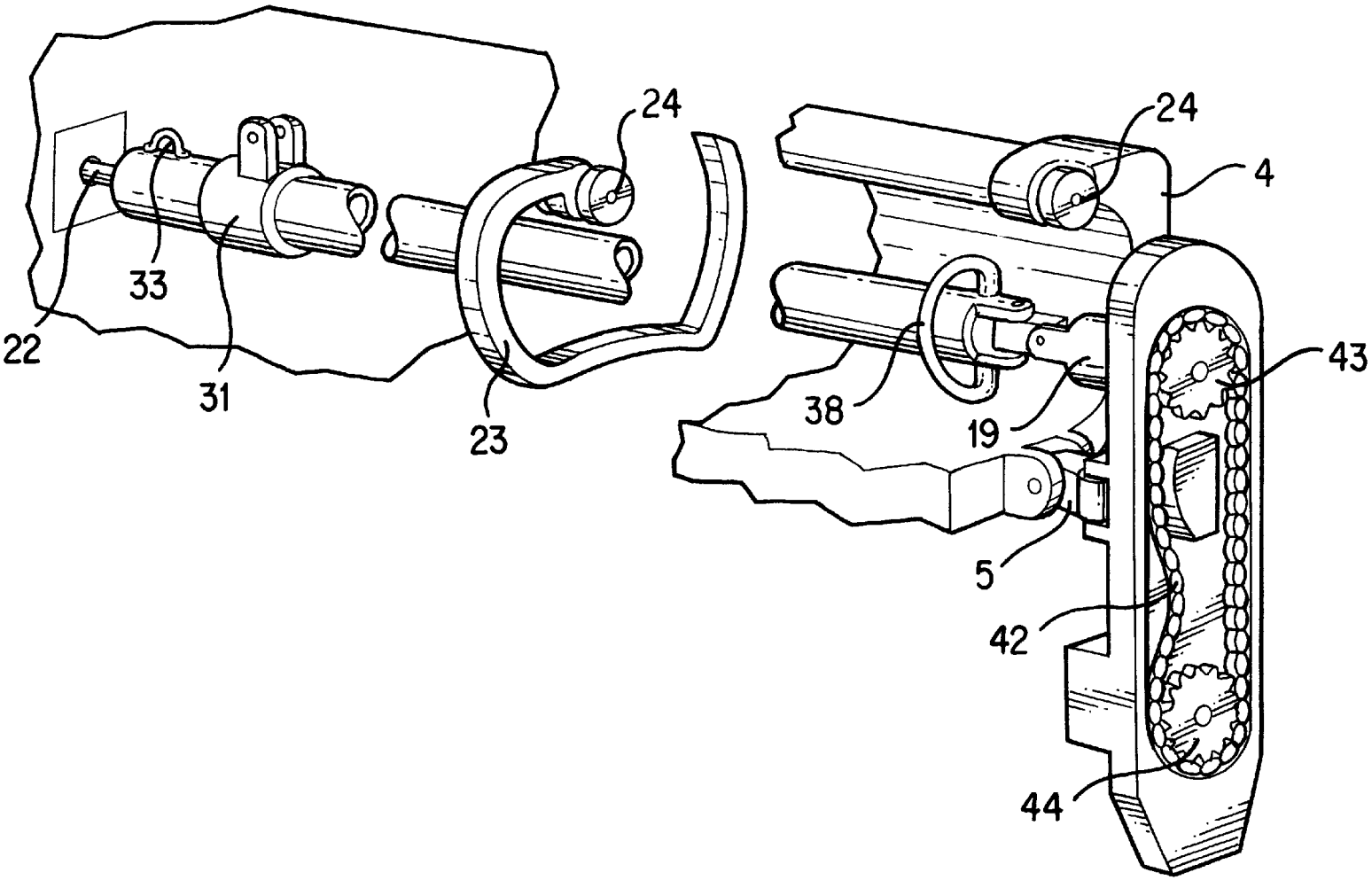
FIG. 2 illustrates a cut away view of the furling boom as shown in FIG. 1.

As shown in FIGS. 1 and 2, the mandrel (17) is connected by a universal joint (1B), to the drive take off (19) of the drive housing (1). A rotating cone (20) made of any suitable material, such as nylon is placed over the forward part of the universal joint (18). The cone (20) alleviates wear and chafing between the said (21) and the bearing housing of the power take off (19). Further the cone (20) prevents the said (21) from riding forward over the bearing housing.

The mandrel (17) is rotatably connected to the aft axle (22), which is pivotally connected to the end casting (15). This floating aft axle (22), during furling and unfurling, prevents binding and friction, when the mandrel (17) is bent upwardly.

As shown in FIG. 2, a one piece c-shaped guide claw (23) is positioned preferably positioned approximately ⅔ along the length of the boom (3) away from the mast (2). Located on the free ends of the claw (23) and the free ends of the end casting (4) are anti chaffing rollers (24), which provide ease of movement of the sail (21) into and out of the boom (3). The c-shaped guide claw (23) is fitted inside the boom (3) and is screwed to the inner walls (25) of the reinforced corners (16) of the boom (3), shown in FIG. 3, to assist in providing stability and rigidity of the boom (3).

A sail cover (74) is covered by a plastics or fabric liner (26) fitted in the channels (27) of the lower part of the side boom extrustion (7). The sail cover (74) is controlled by means of cords connected to the sail cover (74) and runs around the back rollers (28) in the aft end casting (15)(see FIG. 1), and along the top channels (29) in the top extrusions (8) of the boom (3), to close the top opening.

In one embodiment, as shown in FIGS. 1 & 2, the clew (30) of the sail (21) is connected to an aft clew sliding swivel (31) which allows for the attachment the line (32) to the saddle (33) of the mandrel (17). This allows for the auto tensioning of the sail upon rotation of the mandrel (17).

Figure 5:
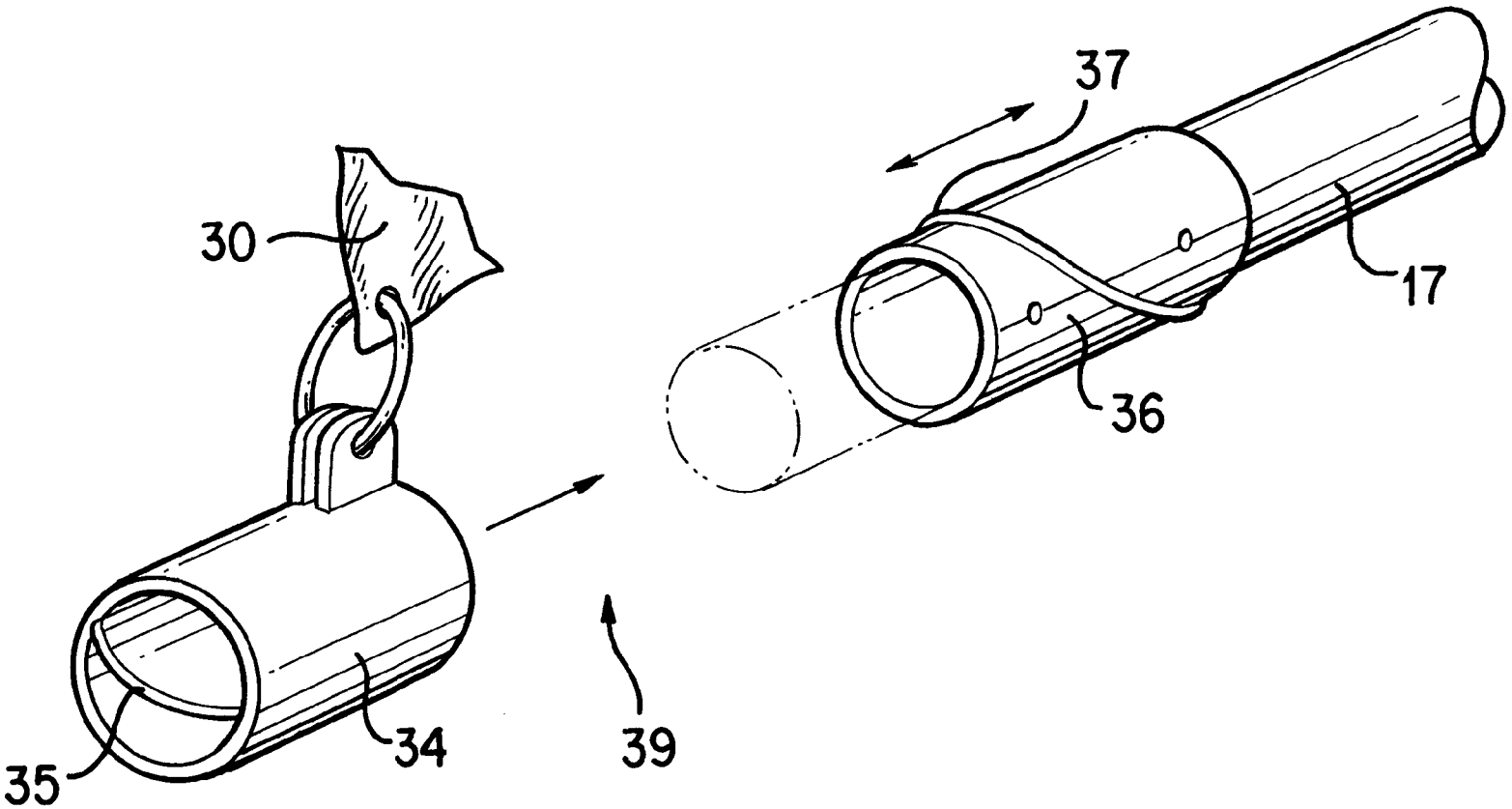
FIG. 5 shows in detail one embodiment of the auto sail foot tensioner, according to an embodiment of the present invention.

In a further embodiment as shown in FIG. 5, the clew (30) of the sail (21) is connected to an auto sail foot tensioner (39). The tensioner (39) comprises an outer casting (34), to which the clew (30) of the sail (21) is affixed, and having an internal spiral groove (35), and an inner casting (36) rigidly affixed to the mandrel. The inner casting (36) has a complementary raised thread (37), such that upon rotation of the mandrel (17), the outer casting (36) moves along the raised thread (37) and hence along the mandrel (17) changing the tensioning of the sail (21).

Figure 6:
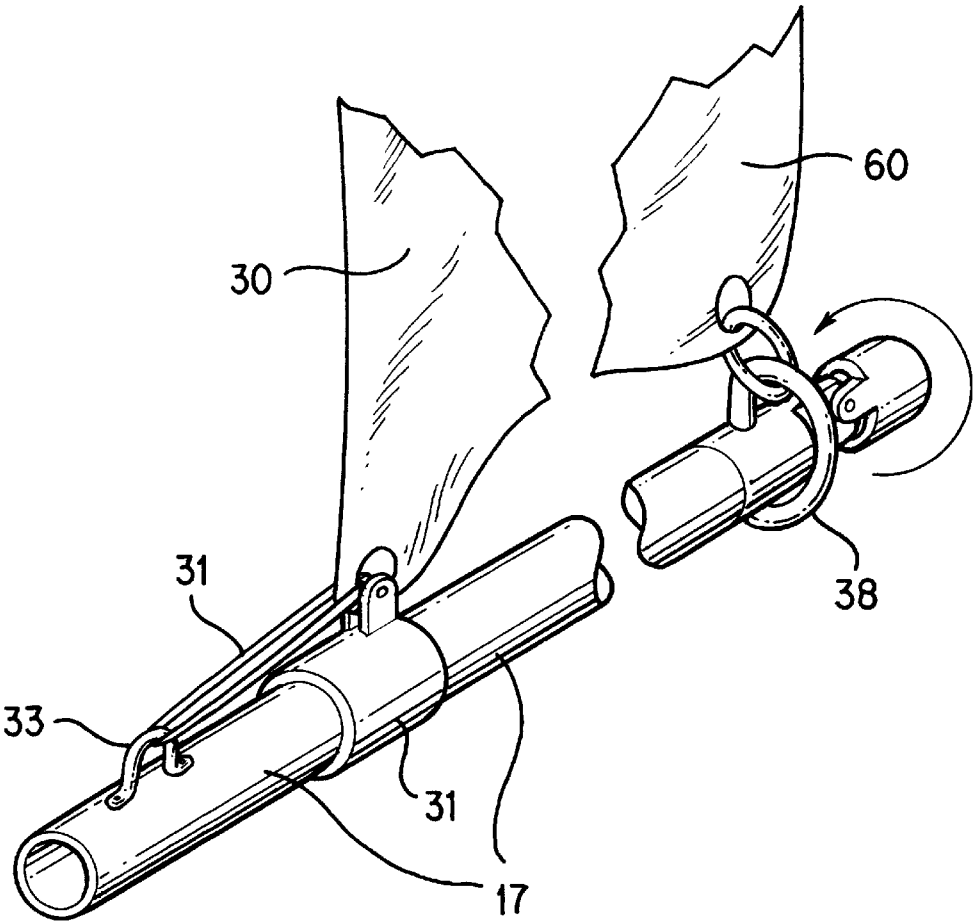
FIG. 6 illustrates an auto tack tensioning means according to another embodiment of the present invention, in a first position.
Figure 7:
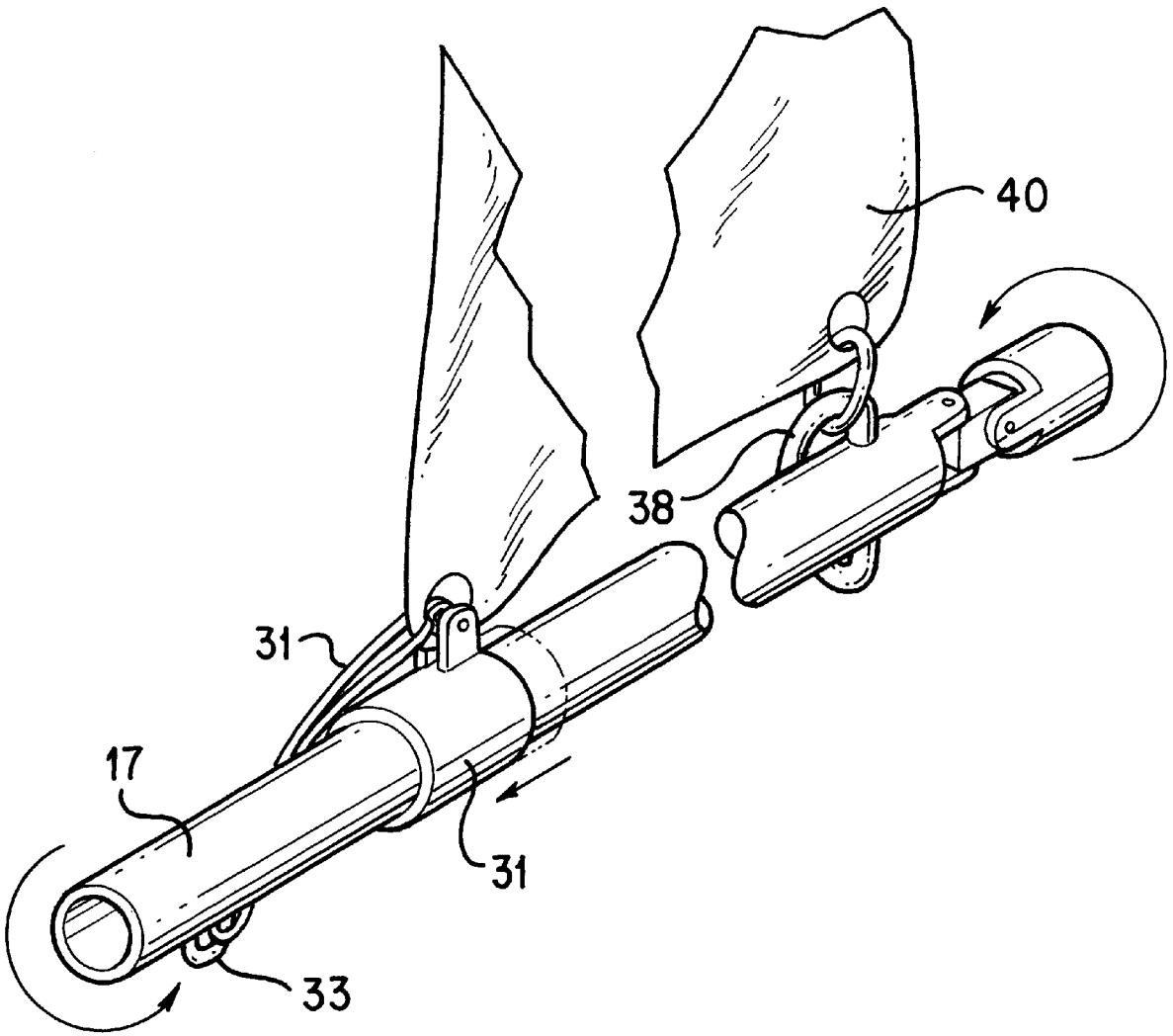
FIG. 7 illustrates the auto tack tensioning as shown in FIG. 6, in a second position.

As shown in FIGS. 6 & 7, the front of the mandrel (17) is provided with a tack slip ring (38), to which is attached the tack (40) of the sail (21), the clew (30) of the sail (21) could be connected to either the auto tensioner (39) or the aft clew swivel (31), as shown. When the mandrel is rotated 180° a "lost motion" is employed allows for releasing or tensioning of the sail foot, to alter the sail for running downwind or tacking upwind, with out the furling of the sail (21). When the mandrel (17) is rotated 180°, as shown in FIG. 7, the tack (40) of the sail (21) slides around the tack slip ring (38), while the aft clew swivel (31) is moved along the mandrel as the line (32) is pulled around the mandrel (17).

Figure 8:
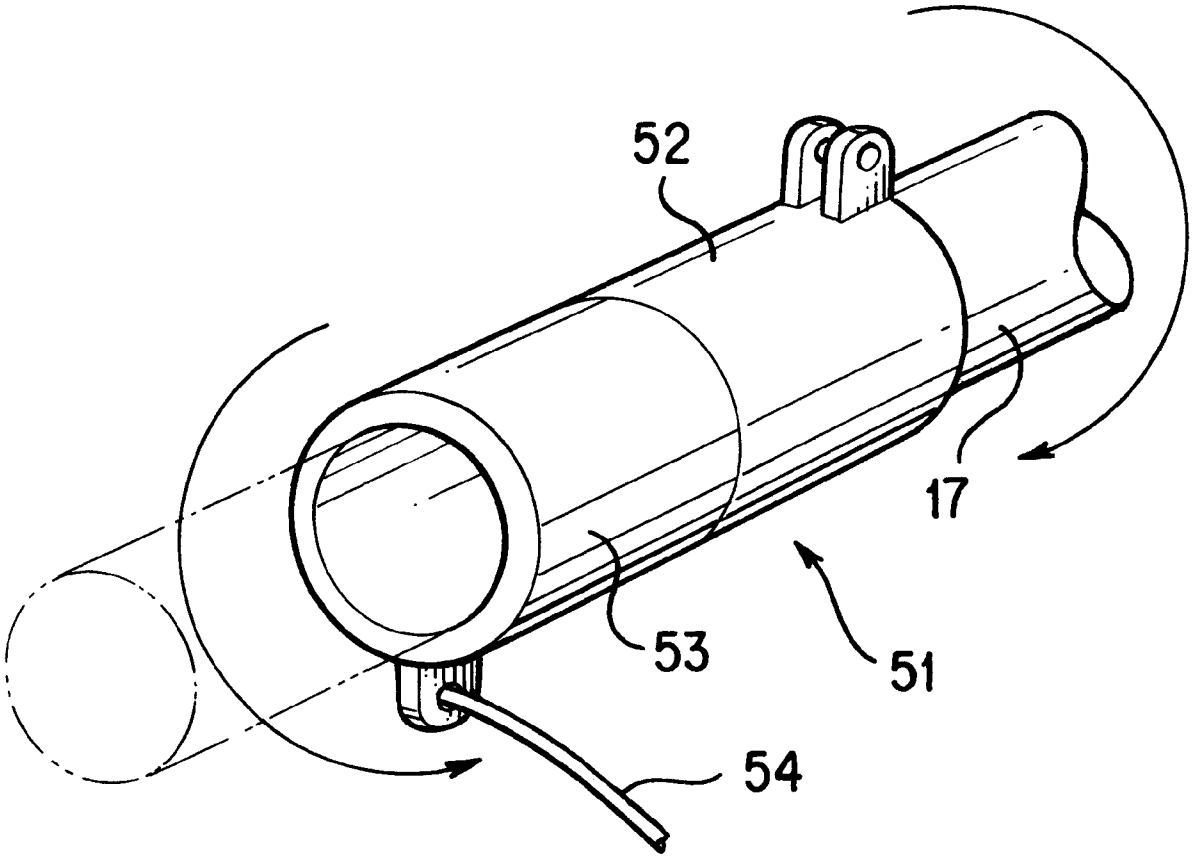
FIG. 8 shows schematically a manual outhaul for the all clew swivel according to one embodiment of the present invention.

As shown in FIG. 8 in another embodiment, a manual outhaul is provided. This comprises a two part aft clew swivel (51), comprising the clew connection section (52) which has a limited rotation of 180° around the mandrel (17), and the outhaul connection section (53) which is free to rotate around the mandrel (17); the two sections (52 & 53) being able to rotate about the mandrel (17) independent of each other, yet move along the mandrel as a unit. The aft swivel (51) can slide along the mandrel. This allows the sail to be furled without the outhaul line (54) wrapping around the mandrel (17).

Figure 4:
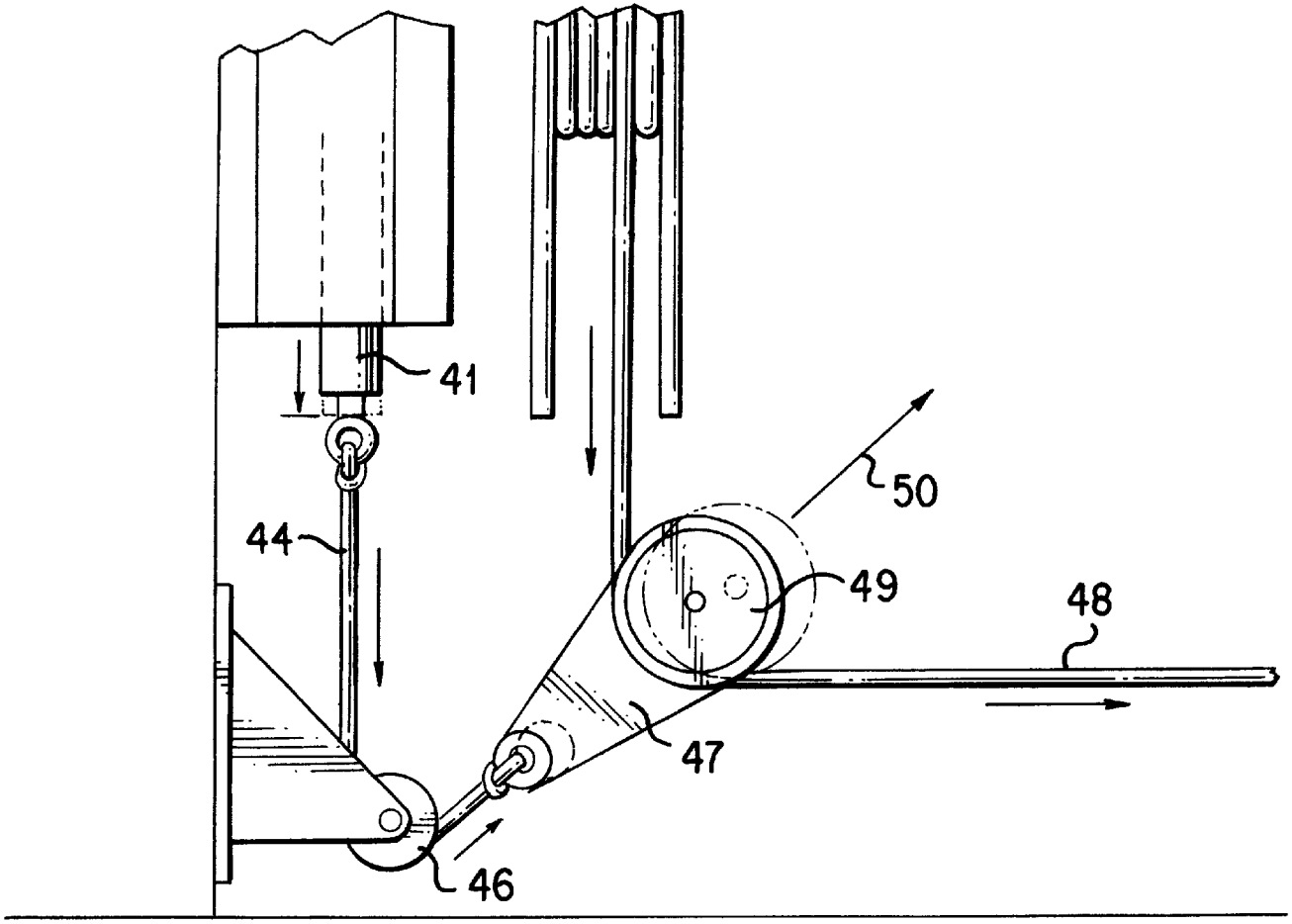
FIG. 4 illustrates an auto ratchet release according to an embodiment of the present invention.

As shown in FIG. 2, a drive chain (42) connects the drive take off sprocket (43) to the drive sprocket (44). Any suitable connection such as gears or belts could be used between the two sprockets. Any suitable drive unit could be connected to the drive sprocket, such as hydraulic, electric, rope drive or manual. However, as shown in FIGS. 2 & 4, a ratchet pin (41) engages on a ratchet (not shown) on the drive to prevent creep on the furling line, and hence distortion of the sail shape. Therefore it is necessary to release the ratchet pin (41) in order to raise the sail (21).

In one embodiment an auto ratchet release system is shown in FIG. 4. The ratchet pin (41) is connected by a line (41) around the pulley (46) to a pulley block (47). The furling line (48) runs around the pulley (49) on the pulley block (47). Therefore when tension is applied on the furling line (48), the pulley block (47) moves in the direction of the arrow (50), which releases the ratchet pin (41), allowing the sail to be raised.

Figure 10:
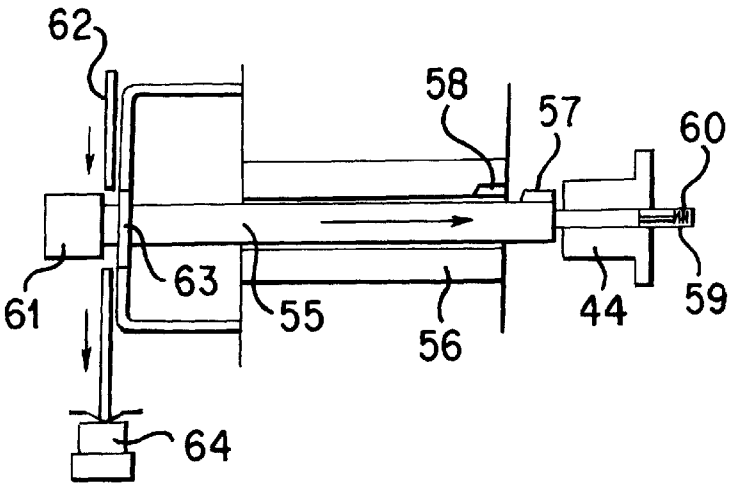
FIGS. 9 & 10 illustrate schematically a manually operable over ride for an electrically or hydraulically driven embodiment of the present invention.
Figure 9:
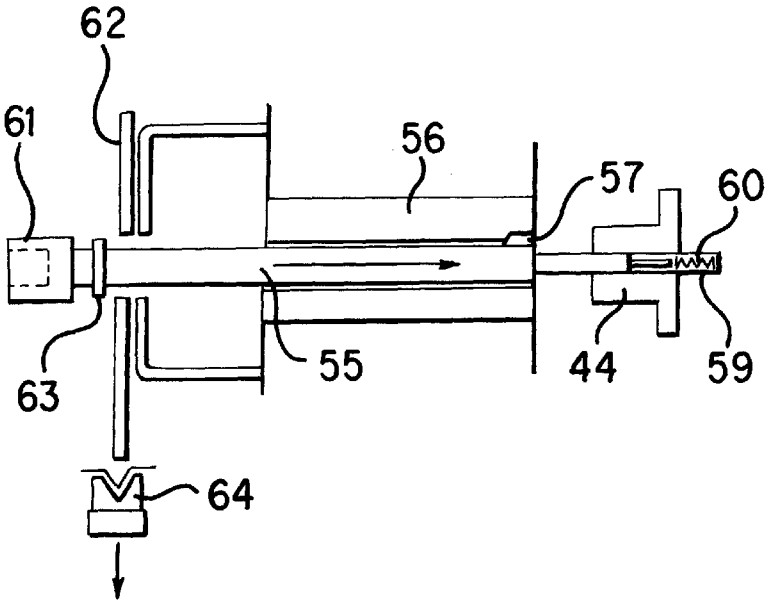

In the case of a breakdown of the electric motor drive it is necessary to disconnect the drive for manual operation. Such an embodiment of the present invention is shown in FIGS. 9 & 10. The drive shaft (55) extends through the gear shaft (56), and has a key (57) which mates is a recess (58) in the gearbox shaft (56). The drive end of the shaft (55) is square or the like in cross section and engages in the central bore (59) of the drive sprocket (44). Located in the central bore (59) is a spring (60) which forces the drive shaft (55) away from the drive sprocket (44), such that the key (57) is held in engagement with the recess (58) connecting the gearbox shaft (56) to the drive sprocket (44).

To disengage the motor from the drive sprocket (44), the free end (61) of the drive shaft (56) is pushed inwardly against the spring (60) moving the key (57) out of engagement with the recess (58). To hold the disengagement a locking plate (62) drops down onto the shaft (55), such that the collar (63) abuts against the locking plate (62). On a method of operating the locking plate (62) involves a knob (64), which when twisted lowers the locking plate (62). A suitable lever engages the end of the drive shaft (55), and the drive shaft (55) is thereby rotated, turning the drive sprocket (44). When the locking plate is withdrawn the spring biases the key (57) against the against the gearbox shaft (56), where when the gearbox shaft (56) is rotated the key (57) is forced into engagement with the recess (58), thereby engaging the drive sprocket (44) with the motor.

Figure 11:
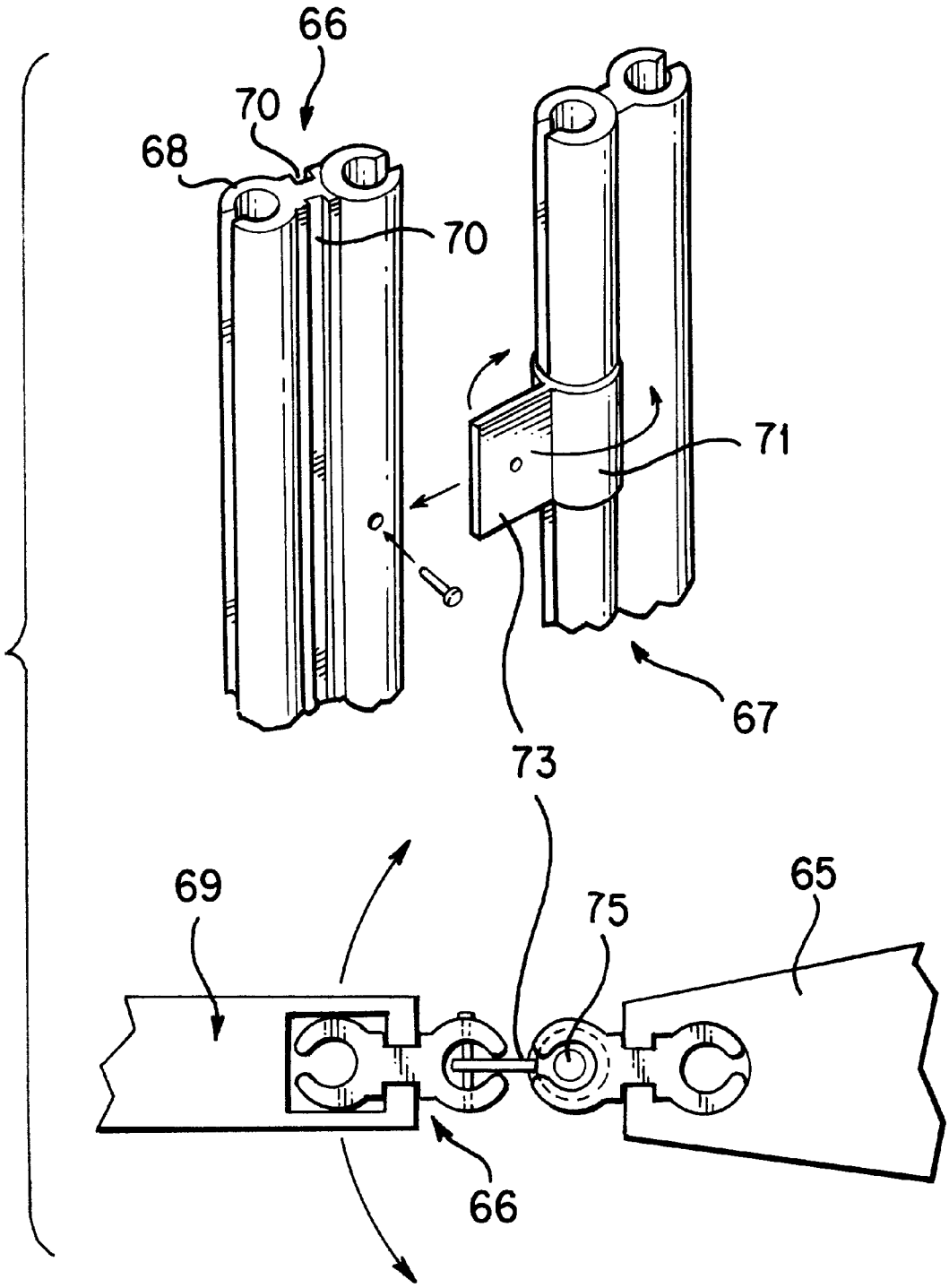
FIG. 11 shows schematically a swivel wedge for attachment of the sail to the mast.

The sail can be connected to a plastics runner (66) directly to the mast foil (65). However a pivoting connector (67) could be used, as shown in FIG. 11. The sail is connected to the plastics runner (66) in the channel (68), with the batten ends (69) locked in the grooves (70). However a hinged runner (71) is slid into the mast foil channel (72). This runner has at various distances along its length a hinged section (73) which is free to rotate. The hinged section (73) is pinned to the runner (66) by a hinge pin (75). This construction allows runner (66) to rotate parallel to the mast, such that the runner (66) remains parallel with the sail shape and the angle of the sail battens (69).

It should be obvious to people skilled in the art that modifications and alterations can be made to the above described embodiments without departing from the scope and spirit of the invention.

The claims are:

1. A furling boom comprising:

a drive housing adapted for mounting on a mast, said housing comprising a drive take off and a boom support;

a boom of substantially c-shaped cross section, pivotally connected to said boom support, and having its opening facing upwardly;

an elongated mandrel extending within said boom and connected at one end by a universal joint to said drive take off, and at its other end by a rotating axle pivotally connected to the free end of the boom, whereby the foot of a sail is connected to said mandrel and furled thereabout upon rotation of said mandrel; and a drive unit mounted on said drive housing.

2. A furling boom according to claim 1, wherein the drive take off is connected by a chain drive to a drive sprocket to which motor is attached.

3. A furling boom according to any one fo the preceding claims, wherein the tack of the sail is attached to a tack ring located on the mandrel adjacent the universal joint.

4. A furling boom according to claim 3, wherein an aft clew swivel is located on the mandrel, which swivel is free to rotate around the mandrel and to slide along the mandrel and is connected by a cord to a saddle affixed to the mandrel, hence when the mandrel is rotated the tack of the sail slides around the tack ring and the aft clew swivel rotates on the mandrel and is slides along the mandrel as the cord is wrapped around the mandrel.

5. A furling boom according to claim 3 wherein the sail has its clew attached to an auto sail foot tensioner which comprises an inner casting connection to the mandrel and having a spiral thread thereon, and an outer casting to which is connected the clew of the sail and having a complementary recess, whereby as the mandrel is twisted, the outer casting travels along the spiral thread and hence along the mandrel changing the tensioning of the sail.

6. A furling boom according to claim 1 or 2 having a furling line connected to the sail, wherein the drive take off has a locking means to prevent rotation of the drive take off, and the locking means is connected by a line around a pulley to a pulley block around which the furling line runs, whereby when tension is applied to the furling line the pulley block moves releasing the locking means.

7. A furling boom according to claim 1 or 2 further comprising a manual outhaul having a two part aft clew swivel, comprising a clew connection section which has a limited rotation of 180° around the mandrel and an outhaul connection section which is free to rotate around the mandrel; the two sections being able to rotate around the mandrel independent of each other, yet move along the mandrel as a unit.

8. A furling boom according to claim 2, further comprising a manual override to disconnect the motor from the drive sprocket.

9. A furling boom according to claim 1 or 2 wherein the sail is connected to a plastics sail runner, which is hingedly connected to runners affixed to the mast, such that the sail runner can rotate parallel to the mast, by the action of the sail.

10. A furling boom according to claim 1 or 2 wherein a plastics cone covers the drive take off housing to discourage the sail from riding forward over the drive take off housing, and limit the wearing of the sail by the drive take off housing and the wear of the housing by the sail.

11. A furling boom according to claim 1 or 2, wherein a one piece C-shaped casting is located at the mast end of the boom and has rollers located at its free ends to prevent chafe or wear of the sail as it bends about the C-shaped casting.

* * * * *